United States Patent [19]

Teramoto et al.

[11] Patent Number: 4,886,558

[45] Date of Patent: Dec. 12, 1989

[54] METHOD FOR HEAT-TREATING STEEL RAIL HEAD

[75] Inventors: Toyokazu Teramoto; Akio Fujibayashi; Kozo Fukuda; Masahiro Ueda; Shinichi Nagahashi; Yazuru Kataoka; Hiroaki Sato; Tsunemi Wada; Takao Gino; Yoshio Saito; Kiyotaka Morioka, all of Tokyo, Japan

[73] Assignee: NKK Corporation, Tokyo, Japan

[21] Appl. No.: 196,317

[22] Filed: May 20, 1988

[30] Foreign Application Priority Data

May 28, 1987 [JP] Japan ..... 62-129885
May 29, 1987 [JP] Japan ..... 62-131754

[51] Int. Cl.[4] ..... C21D 9/04
[52] U.S. Cl. ..... 148/146; 148/144
[58] Field of Search ..... 148/144, 146

[56] References Cited

U.S. PATENT DOCUMENTS

| | | | |
|---|---|---|---|
| 4,201,602 | 5/1970 | Shupe | 148/146 |
| 4,486,243 | 12/1984 | Lambert et al. | 148/146 |
| 4,575,397 | 3/1986 | Heller | 148/144 |
| 4,668,308 | 5/1987 | Economopaulos et al. | 148/146 |

FOREIGN PATENT DOCUMENTS

| | | | |
|---|---|---|---|
| 0186373 | 7/1986 | European Pat. Off. | 148/146 |
| 3446794 | 1/1986 | Fed. Rep. of Germany . | |
| 970968 | 1/1951 | France . | |
| 2109121 | 5/1972 | France . | |
| 2228112 | 11/1974 | France . | |
| 2252541 | 6/1975 | France . | |
| 0050124 | 3/1984 | Japan | 148/146 |
| 0116322 | 7/1984 | Japan | 148/146 |
| 0522751 | 9/1983 | U.S.S.R. | 148/146 |

*Primary Examiner*—Upendra Roy
*Attorney, Agent, or Firm*—Frishauf, Holtz, Goodman & Woodward

[57] ABSTRACT

A method for heat-treating a steel rail head, which comprises: heating a steel rail head to the austenization temperature; then, cooling the rail head by means of a hot water jet until a surface temperature of the rail head decreases to a temperature not below 420° C.; and then cooling the rail head by means of an air jet at least to the pearlite transformation temperature, thereby transforming the structure of a surface portion of the rail head into a uniform and fine pearlite structure. The above-described method includes a method in which the rail head is previously cooled by means of a water spray until the surface temperature of the rail head decreases to a temperature not below 530° C. prior to the cooling of the rail head by means of the above-mentioned hot water jet.

2 Claims, 12 Drawing Sheets

METHOD FOR HEAT-TREATING STEEL RAIL HEAD

FIELD OF THE INVENTION

The present invention relates to a method for cooling a steel rail head, and more particularly, a method for cooling a steel rail head, which permits elimination of variations in hardness caused by non-uniform cooling and reduction of the scale of heat treatment facilities.

BACKGROUND OF THE INVENTION

Because a steel rail (hereinafter referred to as a "rail") head suffers from contact friction with wheels of the vehicle and should bear a heavy load, it is the common practice to apply a heat treatment to the rail head so as to impart an excellent wear resistance thereto.

In order to impart an excellent wear resistance to a rail head through the heat treatment, it is known that the structure of the surface portion of the rail head should preferably be transformed into a uniform and fine pearlite structure. It is therefore necessary to transform the structure of the surface portion of the rail head, which is in contact with wheels of the vehicle, into a uniform and fine pearlite structure excellent in wear resistance to a prescribed depth inwardly from that surface. For the purpose of transforming the structure of the surface portion of a rail head into a fine pearlite structure to a prescribed depth inwardly from that surface, there are available a method known as the isothermal transformation feat treatment, which comprises keeping the rail head at the pearlite transformation temperature by mainly controlling a cooling arrest temperature, and another method known as the continuous cooling transformation heat treatment, which comprises cooling the rail head by mainly controlling a cooling rate. A typical temperature curve in the isothermal transformation heat treatment is shown by (A) in FIG. 1, and a typical temperature curve in the continuous cooling transformation heat treatment is shown by (B) in FIG. 1.

The rail head is cooled with the use of a cooling medium such as air, water, air-water mixture, boiling water, steam, or molten salt. These cooling media have respective problems as follows.

(1) Cooling by air jet:

While cooling by an air jet ensures uniform cooling, the cooling ability thereof is lower than that of cooling by a water spray, for example. In order to improve wear resistance and strength of a rail head, therefore, it is necessary to add alloy elements to the rail, which however causes increase in the manufacturing costs thereof. To avoid this inconvenience, there is available a method of ensuring a desired cooling ability by providing nozzles for the air jet in the proximity of the rail head and ejecting a large quantity of compressed air therefrom onto the rail head. The use of these nozzles however requires a longer cooling zone for an online heat treatment after rolling, resulting in large-scale air source facilities and hence in a disadvantage in equipment.

(2) Cooling by water spray or air-water mixture spray:

These cooling media are far superior to the air jet in the cooling ability. As typical cooling ability of a water spray, the relationship between the surface temperature of a steel plate and thermal conductivity coefficient in the case where a steel plate is cooled at a water volumetric density of 200 l/minute.m$^2$ and 1,000 l/minute.m$^2$ is illustrated in FIG. 2. As is clear from FIG. 2, the thermal conductivity coefficient increases according as the surface temperature of the steel plate becomes lower, leading to a higher cooling ability which reaches the maximum value at a temperature of 200 to 350° C. This is due to nuclear boiling of cooling water. When the rail head is cooled by the water spray, cooling water transits into nuclear boiling with scale having occurred on the rail head surface during rolling and a heat treatment as the nucleus. This local nuclear boiling suddenly reduces the surface temperature of the rail head at this zone, thus producing the martensite structure and the bainite structure, and this causes variations in hardness of the rail head. While the cooling ability is adjusted by adjusting the amount of sprayed water, it becomes difficult to keep uniformity of cooling along with the decrease in the amount of sprayed water. Cooling by an air-water mixture spray has problems similar to those in cooling by the air jet because a considerable amount of air is required in addition to the problem of non-uniform cooling.

(3) Cooling by immersion of the rail head in boiling water:

This cooling comprises forming a steam film on the rail head and obtaining a desired cooling ability through this steam film. This is not however a realistic method because it is almost impossible to uniformly form and maintain a steam film.

(4) Cooling by steam jet:

This cooling has a higher cooling ability than that in cooling by the air jet, but has a disadvantage in equipment because of the necessity of a large quantity of steam for obtaining a fine pearlite structure. (5) Cooling by immersion of the rail head in a molten salt bath:

This cooling poses no problem in terms of control of the cooling rate and uniform cooling. It requires however an apparatus for removing molten salt adhered on the rail head surface after the heat treatment since there is a large amount of molten salt adhered on the rail head surface. It is consequently disadvantageous in the heat treatment facilities and running cost.

Under such circumstances, there is a strong demand for the development of a method for heat-treating a rail head, which permits uniform cooling and minimization of the scale of the heat treatment facilities, but such a method for heat-treating a rail head has not as yet been proposed.

SUMMARY OF THE INVENTION

An object of the present invention is therefore to provide a method for heat-treating a rail head, which permits uniform cooling and minimization of the scale of the heat treatment facilities.

In accordance with one of the features of the present invention, there is provided, in a method for heat-treating a steel rail heat, which comprises:

heating a steel rail head to the austenization temperature; and then, continuously cooling said rail head so that the structure of a surface portion thereof transforms into a uniform and fine pearlite structure;

the improvement characterized by:

carrying out said cooling of said rail head by means of a hot water jet until a surface temperature of said rail head decreases to a temperature not below 420° C.; and then cooling said rail head by means of an air jet at least to the pearlite transformation temperature.

The above-described method includes a method, wherein: said rail head is previously cooled by means of a water spray until said surface temperature of said rail head decreases to a temperature not below 530° C. prior to said cooling of said rail head by means of said hot water jet.

BRIEF DESCRIPTION OF THE DRAWINGS

FIG. 5 (B) is a side view of FIG. 5 (A) along the line A—A;

FIG. 6 (B) is a graph illustrating the relationship between the cooling time and the maximum recuperation temperature in the case where a head of a test piece of a rail is cooled by a hot water jet at a cooling rate of 5° C. per second;

FIG. 6 (C) is a graph illustrating the relationship between the cooling time and the maximum recuperation temperature in the case where a head of a test piece of rail is cooled by a hot water jet at a cooling rate of 10° C. per second;

FIG. 10 (B) is a side view of FIG. 10 (A) along the line A—A;

FIG. 10 (C) is a side view of FIG. 1o (A) along the line B—B;

FIG. 13 (B) is a graph illustrating the relationship between the cooling time and the maximum recuperation temperature in the case where a head of a test piece of a rail is cooled by a water spray at a cooling rate of 5° C. per second;

FIG. 13 (C) is a graph illustrating the relationship between the cooling time and the maximum recuperation temperature in the case where a head of a test piece of a rail is cooled by a water spray at a cooling rate of 10° C. per second;

FIG. 15 (B) is a side view of FIG. 15 (A) along the line A—A;

FIG. 15 (C) is a side view of FIG. 15 (A) along the line B—B;

FIG. 15 (D) is a side view of FIG. 15 (A) along the line C—C;

DETAILED DESCRIPTION OF PREFERRED EMBODIMENTS

From the above-mentioned point of view, extensive studies were carried out to develop a method for heat-treating a rail head, which permits uniform cooling and minimization of the scale of the heat treatment facilities. As a result, there was obtained a finding that it is possible to achieve uniform cooling and minimization of the scale of the heat treatment facilities of a rail head by cooling the rail head by means of a hot water jet until the surface temperature of the rail head decreases to a prescribed temperature, and then, cooling the rail head by means of an air jet at least to the pearlite transformation temperature.

The present invention was made on the basis of the above-mentioned finding. Now, the method for heat-treating a rail head of the present invention is described below with reference to the drawings.

Figure 1:
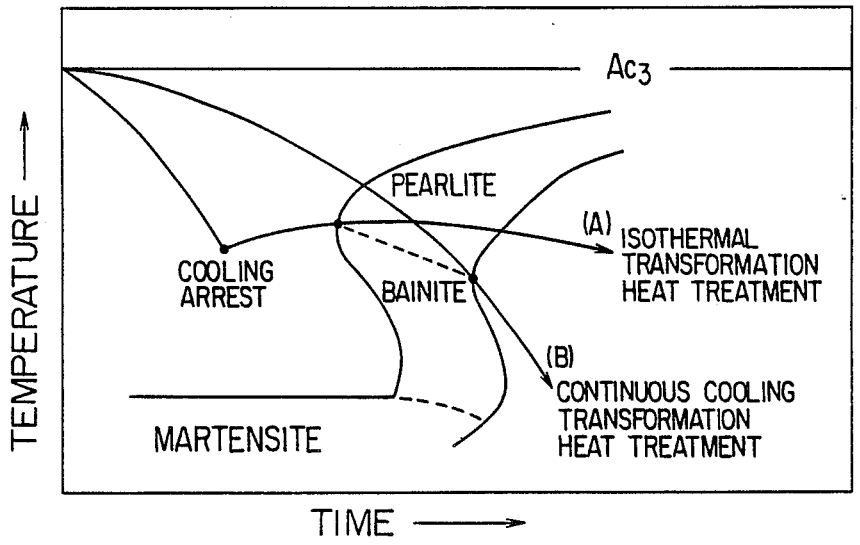
FIG. 1 is a diagrammatic view illustrating the transformation of the structure of steel.
Figure 2:
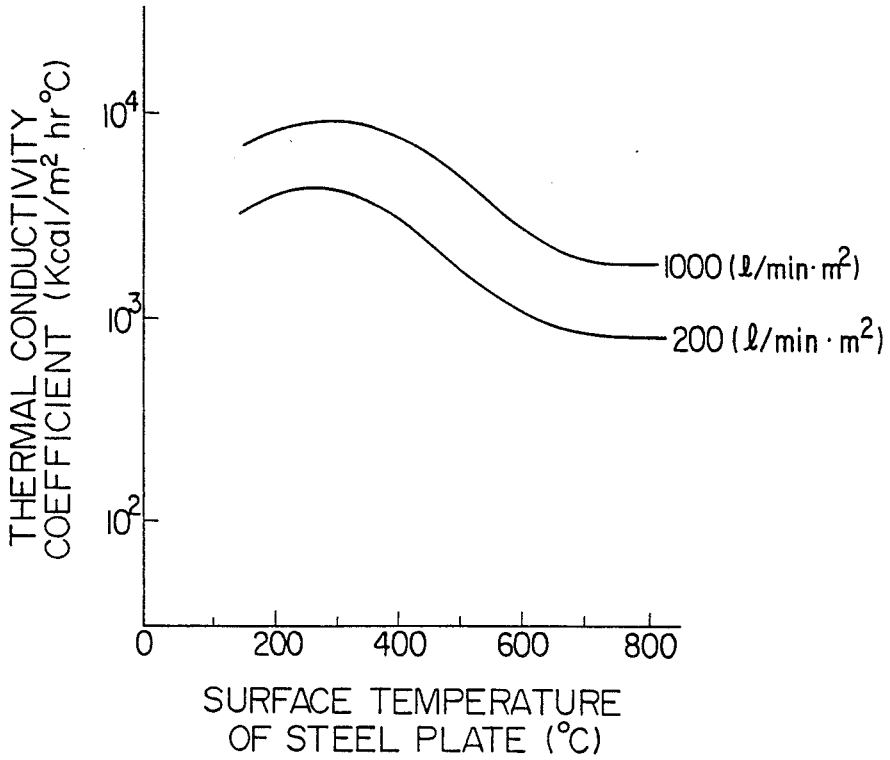
FIG. 2 is a graph illustrating the relationship between the surface temperature of a steel plate and thermal conductivity coefficient, with a water volumetric density as the parameter.

In the present invention, the heat treatment of a rail head is limited to a continuous cooling transformation heat treatment as shown by (B) in FIG. 1 because of the possibility of rapid cooling of the rail head even after the completion of transformation. An isothermal transformation heat treatment is not in contrast desirable because of the occurrence of self softening annealing after the completion of transformation.

A continuous cooling transformation heat treatment comprises: heating a rail head to the austenization temperature, and then, continuously cooling the rail head at a prescribed cooling rate so that the temperature curve passes through the fine pearlite transformation region which forms the lower portion of the pearlite transformation region in contact with the austenite transformation region as shown in FIG. 1, thereby transforming the structure of the surface portion of the rail head into a uniform and fine pearlite structure.

Now, the reason why, in cooling the rail head, the temperature not below 420° C. is used as the temperature at which cooling by a hot water jet is switched over to cooling by an air jet in the present invention is explained.

Figure 3:
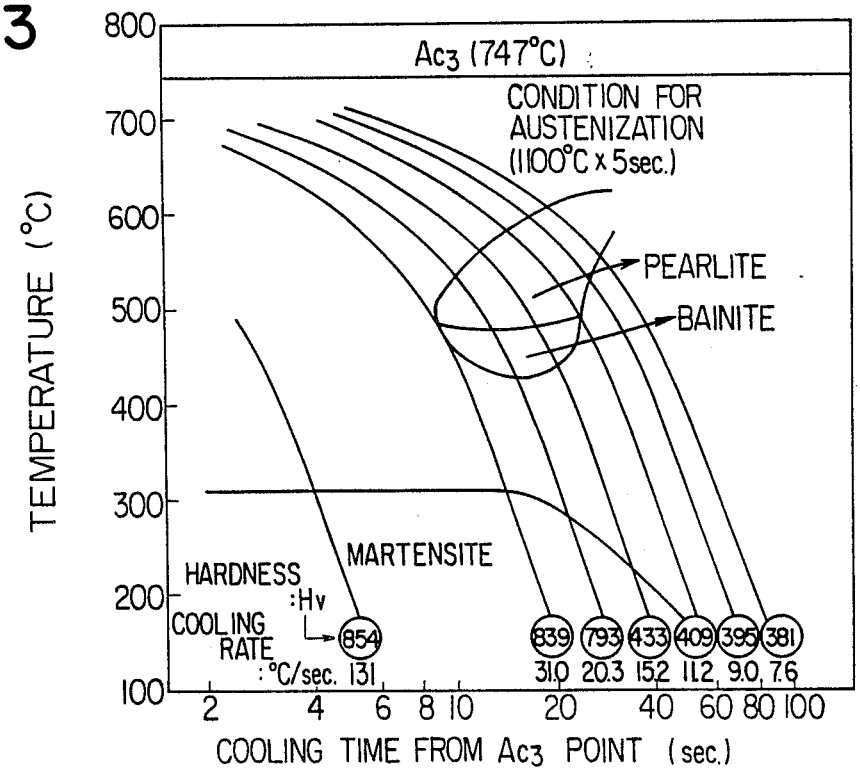
FIG. 3 is a graph illustrating the relationship between the cooling time from the $A_{C3}$ point, the steel structure, and hardness in the case where a rail head is subjected to a continuous cooling transformation heat treatment.

FIG. 3 illustrates the relationship between the cooling time from the $A_{C3}$ point, the steel structure, and hardness in the case where a rail head made of steel containing 0.77 wt. % C., 0.25 wt. % Si, 0.85 wt. % Mn, 0.016 wt. % P and 0.007 wt. % S is subjected to the continuous cooling transformation heat treatment.

In order to transform the structure of the surface portion of the rail head into the pearlite structure, as is clear from FIG. 3, it is necessary to cool the rail head from the austenization temperature at least to the pearlite transformation temperature at a cooling rate of up to 11° C./second.

Figure 4:
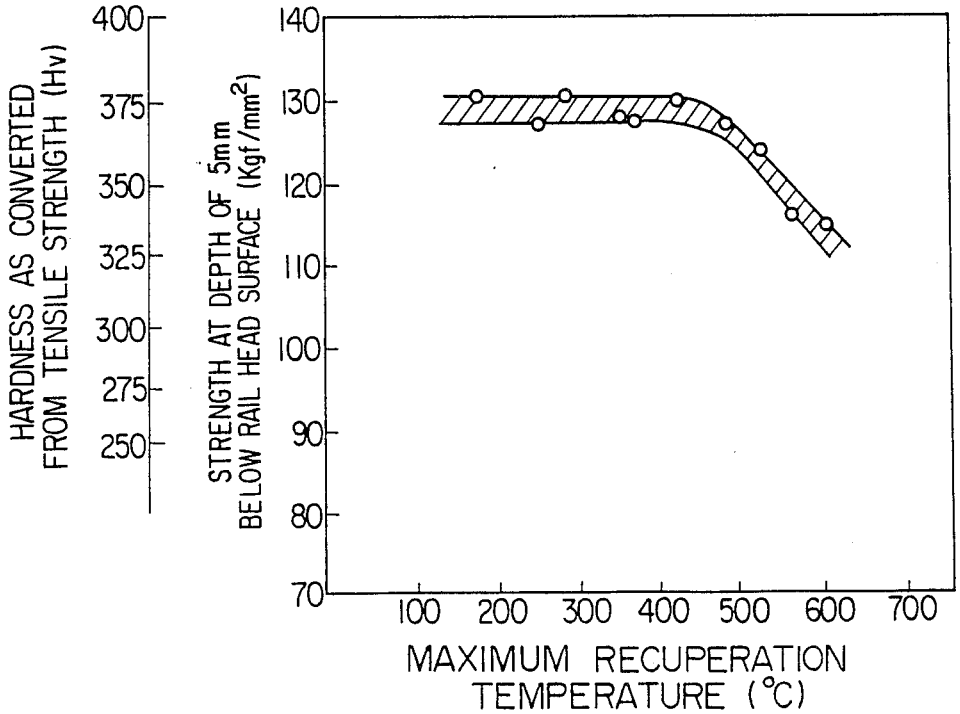
FIG. 4 is a graph illustrating the relationship between the maximum recuperation temperature, hardness as converted from tensile strength, and strength at a depth of 5 mm below the rail head surface.

In order to prevent self softening annealing after the heat treatment, it is necessary to cool the rail head so that the maximum recuperation temperature is up to 450° C. as shown in FIG. 4. FIG. 4 illustrates the relationship between the maximum recuperation temperature, hardness as converted from tensile strength, and strength at a depth of 5 mm below the rail head surface in the case where a rail made of a known steel containing 0.77 wt. % C., 0.25 wt. % Si, 0.86 wt. % Mn, 0.017 wt. % P and 0.008 wt. % S is cooled at a cooling rate of 4.8° C./second.

Figure 5:
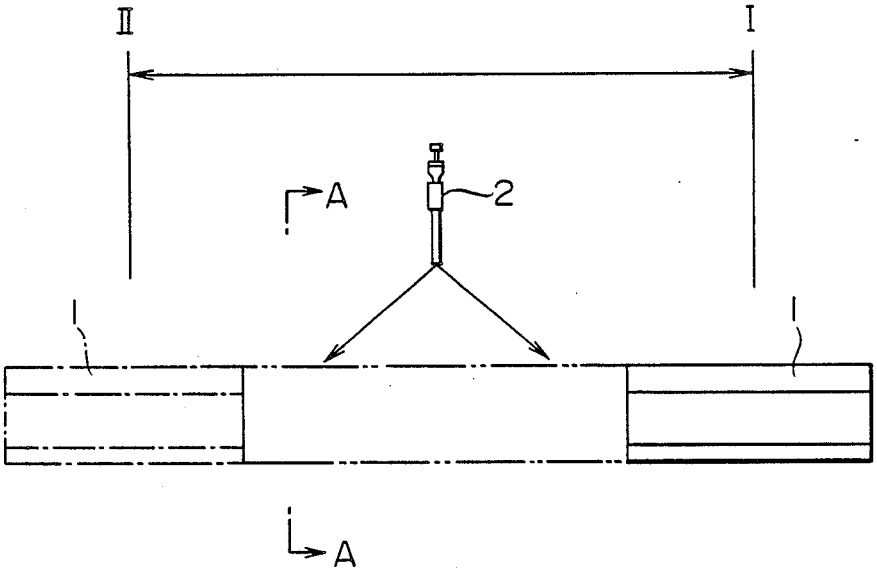
FIG. 5 (A) is a front view illustrating a head of a test piece of a rail being cooled by a hot water jet.
Figure 5:
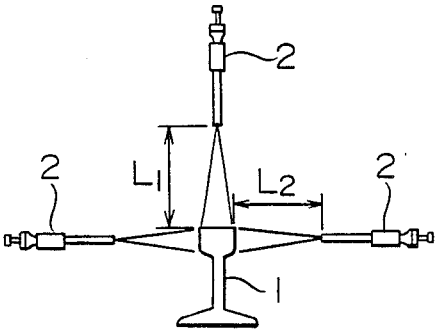

A thermocouple was installed at a depth of 5 mm from the upper surface of the head of a test piece 1 having a length of 500 mm of a 136 pound/yard rail made of steel containing 0.75 wt. % C., 0.24 wt. % Si, 0.90 wt. % Mn, 0.016 wt. % P, and 0.008 wt. % S, and the test piece 1 was heated to a temperature of 900° C. Then, the test piece 1 was left to cool in the open air on a return-movable car until the temperature thereof becomes 800° C. Subsequently, while causing the test piece 1 to go and return within a cooling zone (between I and II in FIG. 5 (A)), the head of the test piece 1 was cooled by ejecting hot water from nozzles 2 for a hot water jet, provided each above and on the both sides of the head of the test piece 1, onto the head of the test piece 1, as shown in FIGS. 5 (A) and 5 (B). Cooling of the test piece 1 was carried out at each of cooling rates of 2° C./second, 5° C./second and 10° C./second. For each of the cooling rates, cooling was arrested during various periods of time to investigate the maximum recuperation temperature of the head of the test piece 1. The cooling conditions in this test are shown in Table 1.

TABLE 1

| | |
|---|---|
| Distance between nozzle and test piece surface | $L_1$ = 200 mm<br>$L_2$ = 200 mm |
| Travelling speed of test piece | 600 mm/second |
| Flow rate of hot water (temperature: 145° C.) | Upper surface of the head of test piece: 9 to 33 l/minute.nozzle<br>Sides of the head of test piece: 8 to 31 l/minute.nozzle |

In Table 1, $L_1$ indicates the distance between the tip of the nozzle 2 and the upper surface of the head of the test piece 1, and $L_2$ indicates the distance between the tip of the nozzle 2 and the side surface of the head of the test piece 1.

Figure 6A:
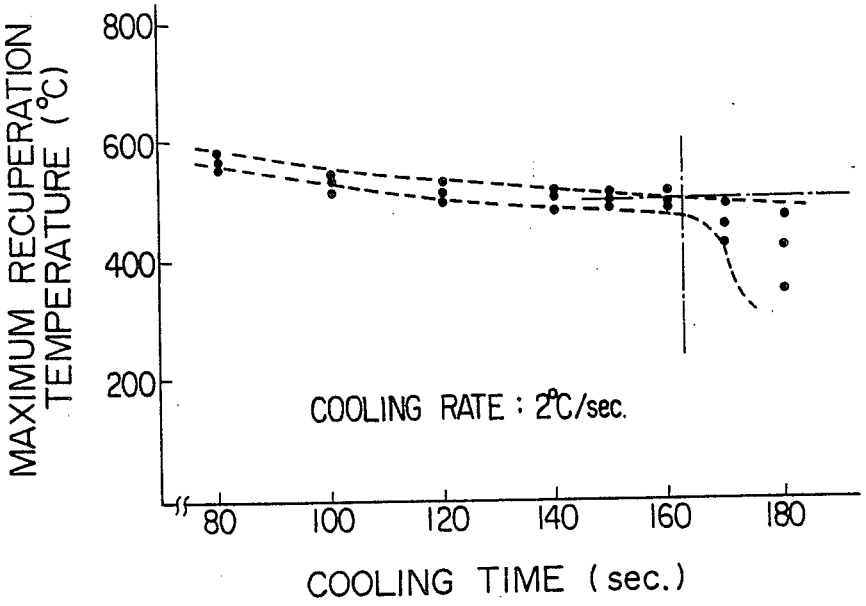
FIG. 6 (A) is a graph illustrating the relationship between the cooling time and the maximum recuperation temperature in the case where a head of a test piece of a rail is cooled by a hot water jet at a cooling rate of 2° C. per second.
Figure 6B:
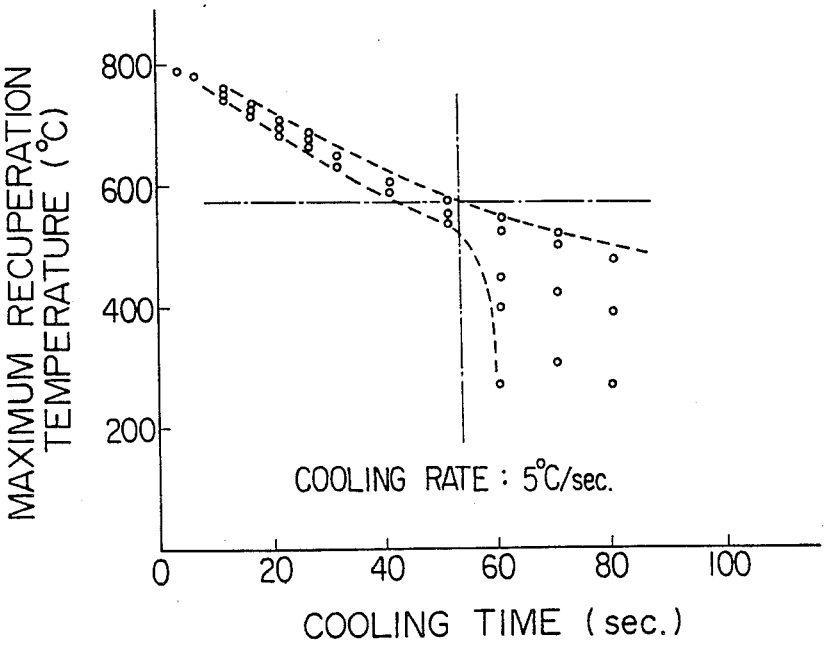
Figure 6C:
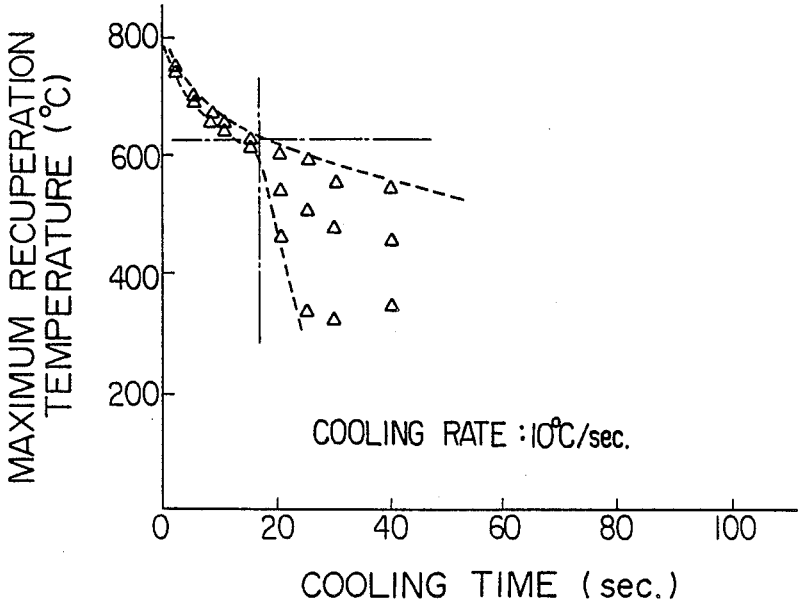

The relationship between the cooling time and the maximum recuperation temperature of the head of the test piece after a cooling arrest is illustrated in FIGS. 6 (A), 6 (B) and 6 (C).

FIG. 6 (A), 6 (B) and 6 (C) suggest that the maximum recuperation temperature of the test piece head largely varies from a certain temperature responsive to the cooling rate.

Then, the relationship between the surface temperature of the test piece head at cooling arrest and the maximum recuperation temperature of the surface of the test piece head was determined by computer under the above-mentioned test conditions. The result is shown in FIG. 7.

Figure 7:
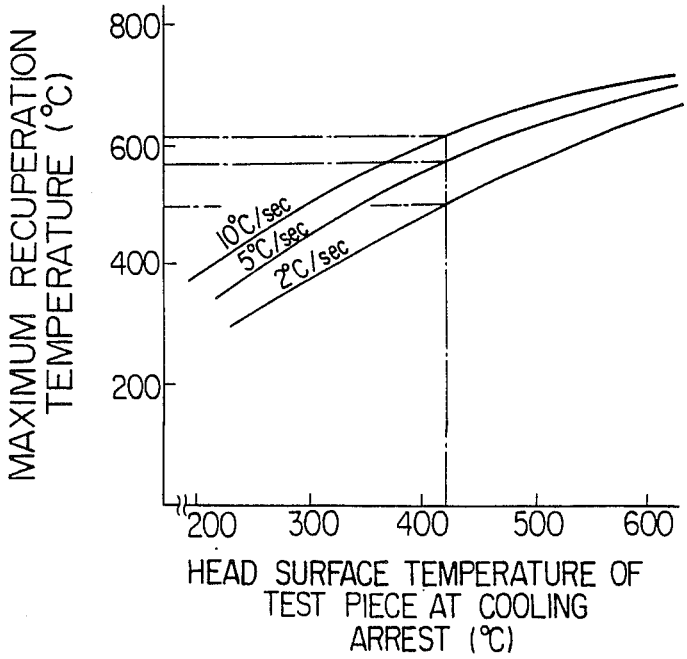
FIG. 7 is a graph illustrating the relationship between the surface temperature of a head of a test piece of a rail at a cooling arrest, and the maximum recuperation temperature, with a cooling rate as the parameter, in the case where the head of the test piece of the rail is cooled by a hot water spray.

As is known from FIGS. 6 and 7, a variation in the maximum recuperation temperature of the head of the test piece occurs, i.e., the head of the test piece is non-uniformly cooled, when the surface temperature of the test piece reaches about 420° C. In the present invention, therefore, the rail head is cooled by means of a hot water jet until the surface temperature of the rail head decreases to a temperature not below 420° C., and then, cooled by means of an air jet which permits uniform cooling. This permits uniform cooling of the rail head and minimization of the scale of the heat treatment facilities as compared with cooling of the rail head with the air jet alone.

Figure 8:
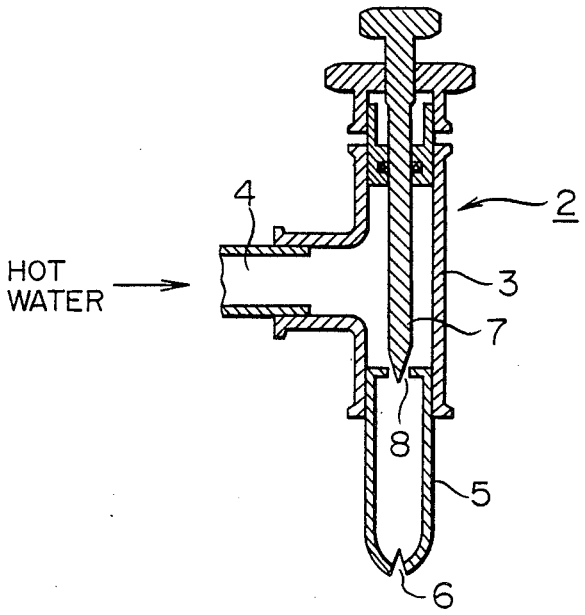
FIG. 8 is a cross-sectional view of a nozzle for cooling by a hot water jet.

As shown in FIG. 8, the nozzle 2 for the hot water jet comprises a nozzle main body 3 having a hot water supply port 4, a nozzle tip 5, fixed to the nozzle main body 3, having a hot water ejecting port 6, and a needle valve 7, inserted into the nozzle main body 3, for adjusting opening of a hot water channel 8. Part of high-temperature and high-pressure hot water having a temperature over 100° C., supplied through the hot water supply port 4 into the nozzle main body 3 is vaporized when it passes through the channel 8 reduced in opening by the needle valve 7. The thus produced hot water containing steam bubbles is ejected from the hot water ejecting port 6 of the nozzle tip 5 in the form of a hot water jet to a wide range.

Figure 9:
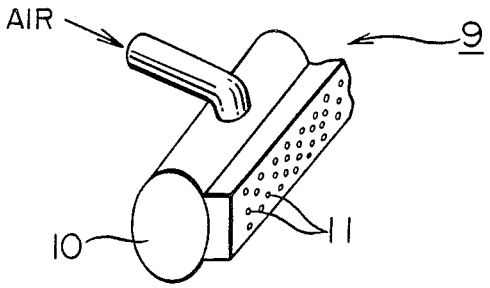
FIG. 9 is a partially cutaway perspective view of a nozzle for cooling by an air jet.

As shown in FIG. 9, the nozzle 9 for the air jet comprises a header 10 and a plurality of air ejection ports 11 fitted to the header 10 over the longitudinal direction thereof.

Now, examples of the method for heat-treating a rail head of the present invention are described with reference to the drawings.

EXAMPLE 1

Figure 10:
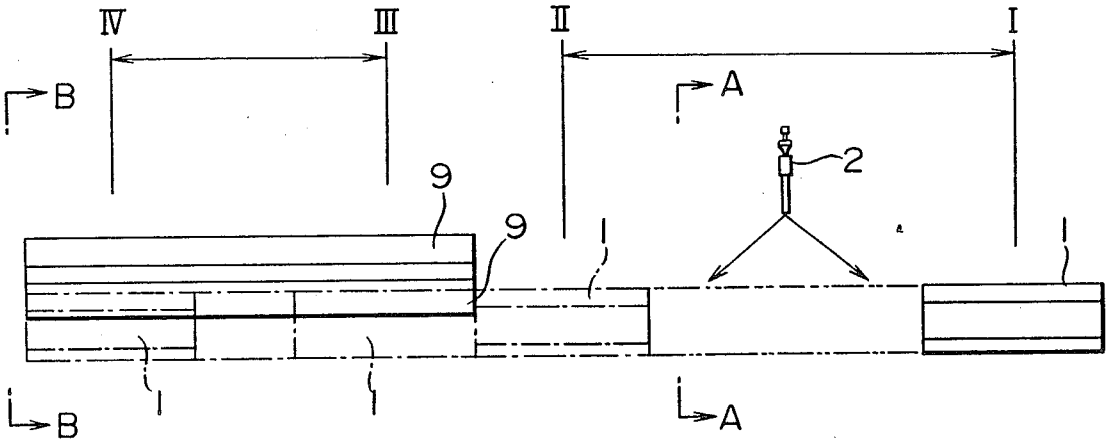
FIG. 10 (A) is a front view illustrating a head of a test-piece of a rail being heat-treated in accordance with an embodiment of the method of the present invention.
Figure 10:
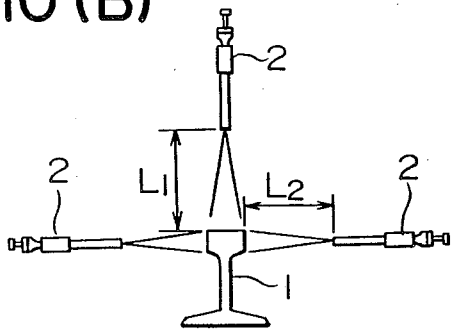
Figure 10:
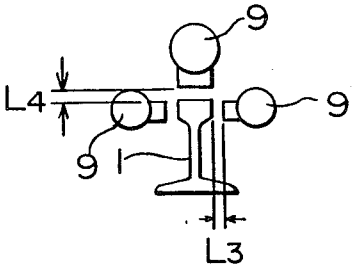

A thermocouple was installed at a depth of 5 mm from the upper surface of the head of a test piece 1 having a length of 500 mm of a 136 pound/yard rail made of steel containing 0.76 wt. % C., 0.25 wt. % Si, 0.91 wt. % Mn, 0.017 wt. % P and 0.007 wt. % S, and the test piece 1 was heated to a temperature of 800° C. Then, while causing the test piece 1 to go and return on a return-movable car (not shown) within a cooling zone by the hot water jet (between I and II in FIG. 10 (A)), the head of the test piece 1 was cooled by ejecting hot water from the nozzles 2 for the hot water jet as shown in FIG. 8, provided each above and on the both sides of the head of the test piece 1, onto the head of the test piece 1, until the surface temperature of the head of the test piece 1 reached a temperature of 420° C., as shown in FIGS. 10 (A), 10 (B) and 10 (C). Subsequently, while causing the test piece 1 to go and return within a cooling zone by the air jet (between III and IV in FIG. 10 (A)), the head of the test piece 1 was cooled by ejecting air from the nozzles 9 as shown in FIG. 9, provided each above and on both sides of the head of the test piece 1, onto the head of the test piece 1, until the surface temperature of the head of the test piece 1 reached a temperature of 220° C. The head surface of the test piece 1 had then a maximum recuperation temperature of 350° C. The cooling conditions in this test are shown in Table 2.

TABLE 2

| Type of cooling | | Cooling by not water jet | Cooling by air jet |
|---|---|---|---|
| Ditance between nozzle and test piece surface | | $L_1$ = 200 mm | $L_3$ = 10 mm |
| | | $L_2$ = 200 mm | $L_4$ = 10 mm |
| Travelling speed of test piece | | 600 mm/second | 300 mm/second |
| Kind and temp. of cooling medium | | Hot water of 145° C. | Air of 30° C. |
| Flow rate of cooling medium | Upper Surface of the head of test piece | 17 l/minute. nozzle | 19 $Nm^3$/minute. m |
| | Side surface of the head of test piece | 15 l/minute. nozzle | 19 $Nm^3$/minute. m |

In table 2, $L_1$ indicates the distance between the tip of the nozzle 2 and the upper surface of the head of the test piece 1;$L_2$, the distance between the tip of the nozzle 2 and the side surface of the head of the test piece 1; $L_3$, the distance between the tip of the nozzle 9 and the upper surface of the head of the test piece 1; and $L_4$, the distance between the tip of the nozzle 9 and the side surface of the head of the test piece 1.

Figure 11:
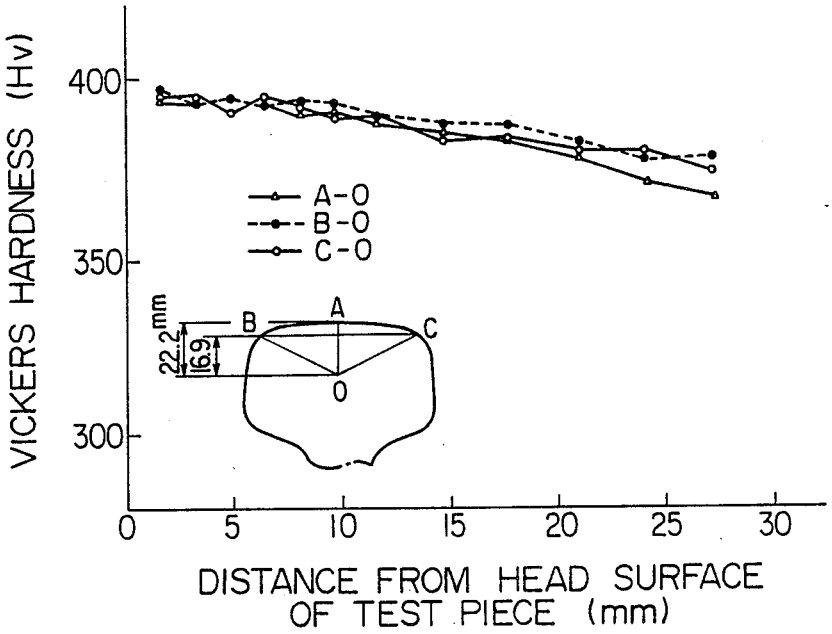
FIG. 11 is a graph illustrating the relationship between the distance from a head surface of a test piece of a rail and Vickers hardness.

The macrostructure and Vickers hardness of the head of the test piece were investigated. As a result, the macrostructure was transformed into a uniform and fine pearlite structure, and no abnormal structure was observed. The Vickers hardness distribution as observed in this test is shown in FIG. 11. FIG. 11 suggests that the head of the test piece has a stable Vickers hardness having a value ensuring a sufficient wear resistance.

EXAMPLE 2

A 136 pound/yard rail, immediately after rolling, made of steel containing 0.78 wt. % C., 0.56 wt. % Si, 0.86 wt. % Mn, 0.002 wt. % P, 0.007 wt. % S, 0.447 wt. % Cr, and 0.054 wt. % V was caused to pass, at a speed of 7.2 m/minute, through a cooling zone by the hot water jet (length: 21 m, hot water temperature: 145° C.) provided with the nozzles for the hot water jet as shown in FIG. 8 and a cooling zone by the air jet (length: 9 m, air temperature: 30° C.) provided with the nozzles for the air jet as shown in FIG. 9, to cool the rail head until the surface temperature of the rail head reached a temperature of 450° C. in the cooling zone by the hot water jet, and until the surface temperature of the rail head reached a temperature of 300° C. in the cooling zone by the air jet. For comparison purposes, the head of the rail of the same kind was cooled only through a cooling zone by the water spray (length: 30 m, water temperature: 25° C.) provided with the known nozzles for the water spray, to investigate the Vickers hardness distribution n the longitudinal direction of the rail at a depth of 20 mm below the upper surface of the rail head.

Figure 12:
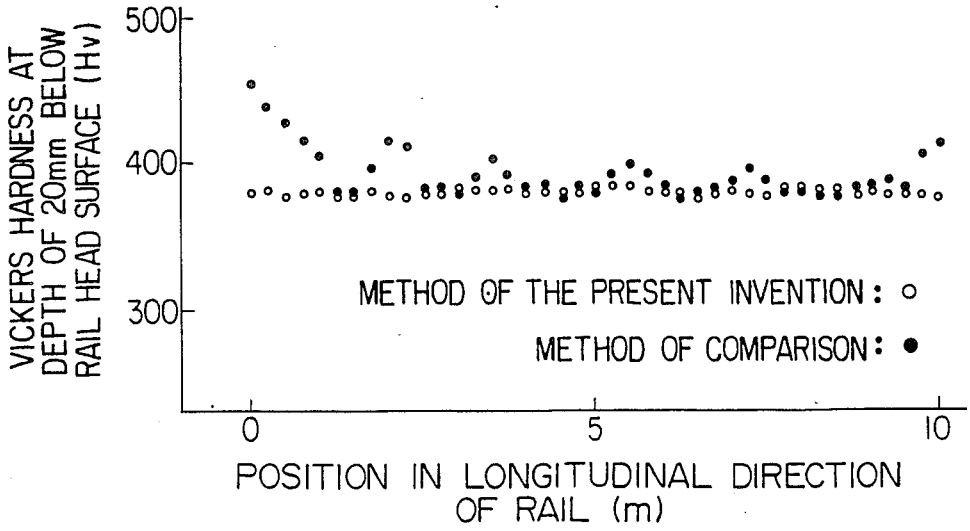
FIG. 12 is a graph illustrating the relationship between a position in the longitudinal direction of a rail and Vickers hardness at a depth of 20 mm below a rail head surface in the case where the rail head is heat-treated by an embodiment of the method of the present invention and the method of comparison.

The result is shown in FIG. 12. As is clear from FIG. 12, the method of the present invention gives a far smaller variation in the Vickers hardness distribution in the longitudinal direction of the rail than in the method of comparison. The hot water consumption in the cooling zone by the hot water jet was 19 $m^3$/hr. in the method of the present invention, and the water consumption was 38 $m^3$/hr. in the method of comparison. The air consumption in the cooling zone by the air jet in this Example was 5,700 $Nm^3$/hr., which represents a decrease of about 70% from the air consumption in the case of the cooling by air jet alone. This decrease in the air consumption contributed to the minimization of the scale of the heat treatment facilities.

Then, in the heat-treating method shown in FIGS. 5 (A) and (B), the head of the test piece of the rail was cooled under the same conditions as those in FIGS. 5 (A) and (B) except that the nozzles for the hot water jet were replaced by the known nozzles for water spray and water in the quantities as shown in Table 3 was sprayed to investigate the relationship between the cooling time and the maximum recuperation temperature of the head of the test piece. The results are shown in FIGS. 13 (A), 13 (B) and 13 (C).

TABLE 3

| | |
|---|---|
| Quantity of sprayed water (water temperature: 25° C.) | Upper surface of the head of test piece: 6 to 22 l/minute.nozzle<br>Sides of the head of test piece: 5 to 19 l/minute.nozzle |

Figure 13:
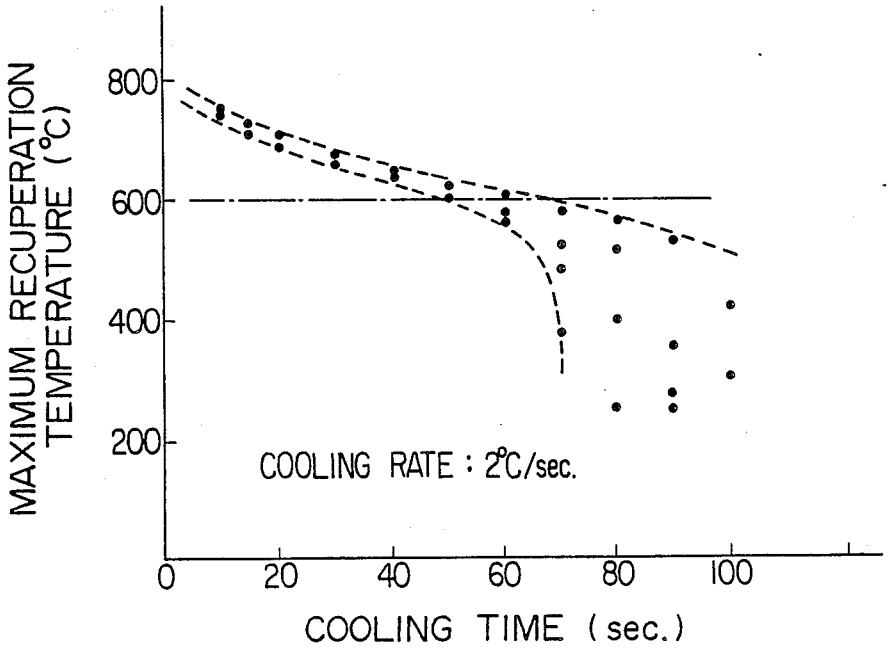
FIG. 13 (A) is a graph illustrating the relationship between the cooling time and the maximum recuperation temperature in the case where a head of a test piece of a rail is cooled by a water spray at a cooling rate of 2° C. per second.
Figure 13:
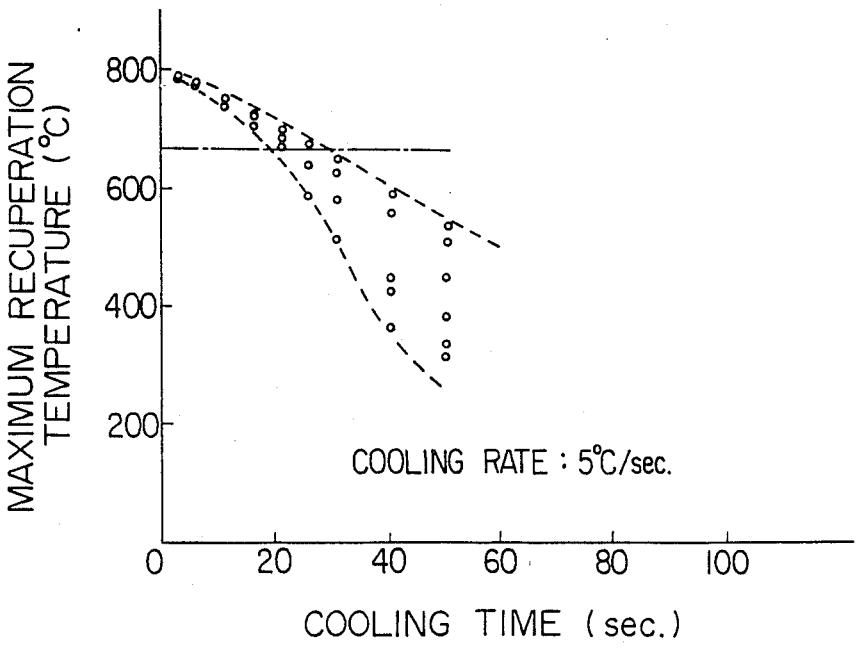
Figure 13:
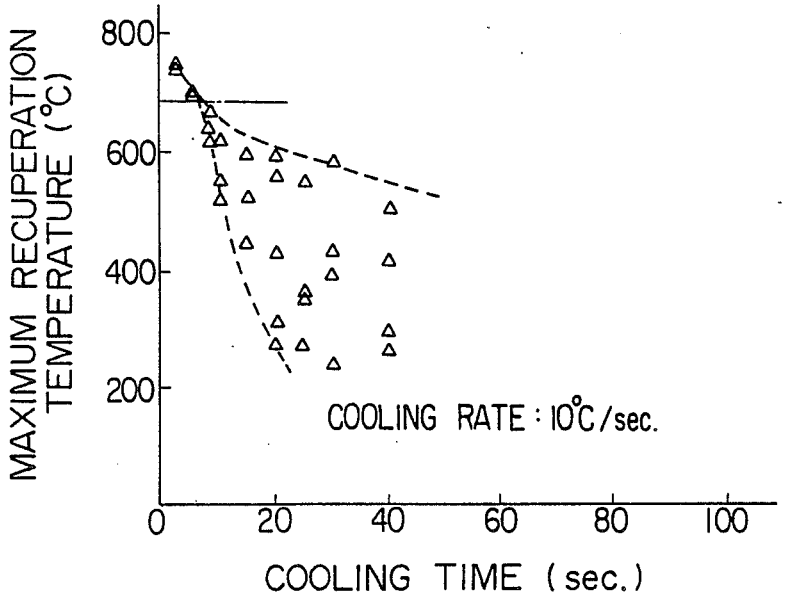

As is evident from FIG. 13 (A), 13 (B) and 13 (C), the maximum recuperation temperature of the head of the test piece largely varies from a certain temperature responsive to the cooling rate.

Then, the relationship between the surface temperature of the head of the test piece at cooling arrest and the maximum recuperation temperature of the head of the test piece was determined by a computer under the above-mentioned test conditions. The result is shown in FIG. 14.

Figure 14:
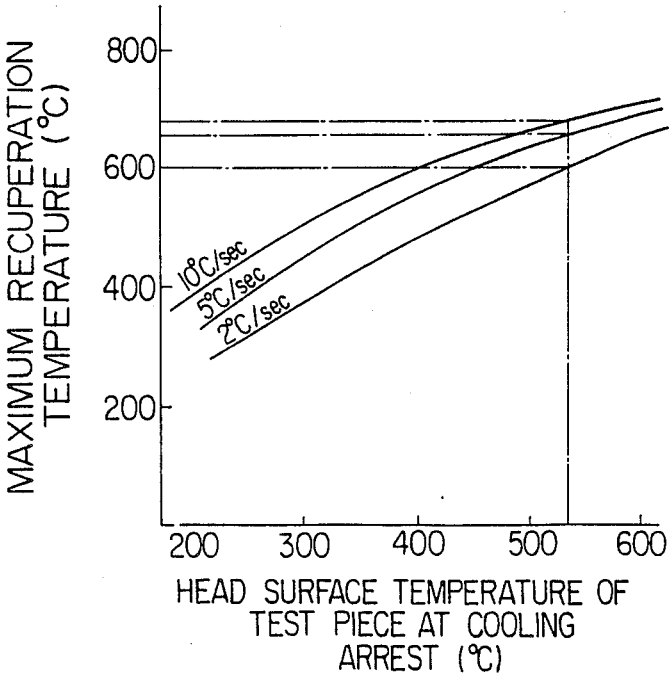
FIG. 14 is a graph illustrating the relationship between the surface temperature of a head of a test piece of a rail at a cooling arrest, and the maximum recuperation temperature, with a cooling rate as the parameter, in the case where the head of the test piece of the rail is cooled by a water spray.

As is known from FIGS. 13 (A), 13 (B) and 13 (C) and FIG. 14, a variation in the maximum recuperation temperature of the head of the test piece occurs, i.e., the head of the test piece is non-uniformly cooled, when the surface temperature of the head of the test piece reaches about 530° C. for the cooling by the water spray, and when the surface temperature of the head of the test piece reaches about 420° C. for the cooling by the hot water jet as described above.

Therefore, by cooling the rail head by means of the water spray until the surface temperature of the rail head decreases to a temperature not below 530° C., then cooling the ail head by means of the hot water jet until the surface temperature of the rail head decreases to a temperature within the range of from a temperature not below 420° C to under the temperature at which the water spray cooling is switched over to the hot water jet cooling, and then, cooling the rail head by means of the air jet to at least the pearlite transformation temperature, it is possible to improve the cooling efficiency of the rail head without non-uniform cooling of the rail head as compared with the case where the rail head is cooled by means of the hot water jet and the air jet.

EXAMPLE 3

Figure 15:
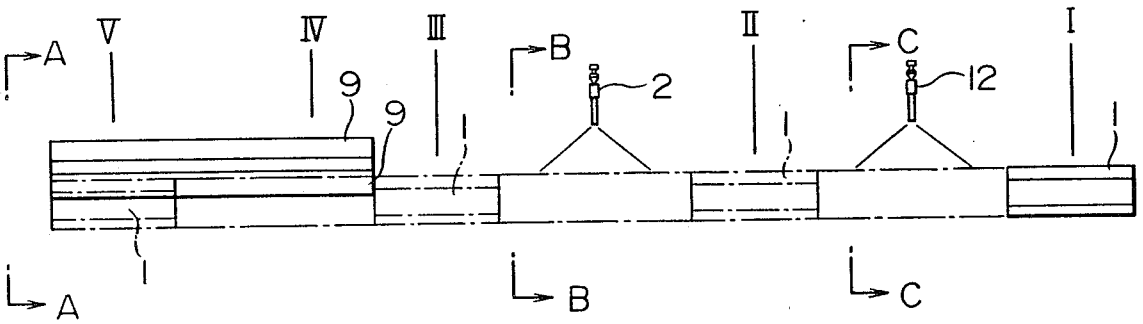
FIG. 15 (A) is a front view illustrating a head of a test piece of a rail being heat-treated in accordance with another embodiment of the method of the present invention.
Figure 15D:
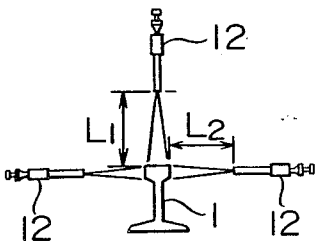
Figure 15C:
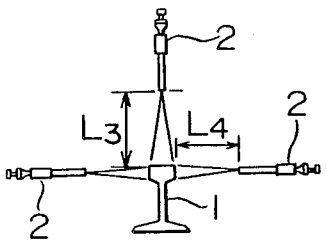
Figure 15B:
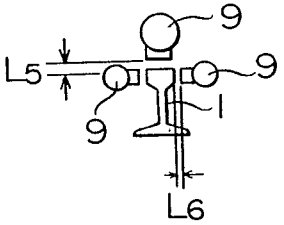

A thermocouple was installed at a depth of 5 mm from the upper surface of the head of a test piece 1 having a length 500 mm of a 136 pound/yard rail made of steel containing 0.76 wt. % C., 0.25 wt. % S, 0.91 wt. % Mn, 0.017 wt. % P, and 0.007 wt. % S, and the test piece 1 was heated to 800° C. Then, while causing the test piece 1 to go and return on a return-movable car (not shown) within a cooling zone by the water spray (between I and II in FIG. 15 (A)), the head of the test piece 1 was cooled by ejecting water from the known nozzles 12 for the water spray provided each above and on the both sides of the head of the test piece 1, onto the head of the test piece 1, until the surface temperature of the head of the test piece 1 reached a temperature of 550° C., as shown in FIGS. 15 (A), 15 (B), 15 (C) and 15 (D). Subsequently, while causing the test piece 1 to go and return within a cooling zone by the hot water jet (between II and III in FIG. 15 (A)), the head of the test piece 1 was cooled by ejecting hot water from the nozzles 2 for the hot water jet as shown in FIG. 8, provided each above and on the both sides of the head of the test piece 1, onto the head of the test piece 1, until the surface temperature of the head of the test piece 1 reached a temperature of 420° C., and then, while causing the test piece 1 to go and return within a cooling zone by the air jet (between IV and V in FIG. 15 (A)), the head of the test piece 1 was cooled by ejecting air from the nozzles 9 as shown in FIG. 9, provided each above and on both sides of the head of the test piece 1, onto the head of the test piece 1, until the surface temperature of the test piece 1 reached a temperature of 200° C. The head surface of the test piece 1 had then a maximum recuperation temperature of 330° C. The cooling conditions in this test are shown in Table 4.

TABLE 4

| Type of cooling | | Cooling by water spray | Cooling by hot water jet | Cooling by air jet |
|---|---|---|---|---|
| Distance between nozzle and test piece surface | | $L_1$ = 200 mm | $L_3$ = 200 mm | $L_5$ = 20 mm |
| | | $L_2$ = 200 mm | $L_4$ = 200 mm | $L_6$ = 20 mm |
| Travelling speed of test piece | | 600 mm/second | 600 mm/second | 300 mm/second |
| Kind an temp. of cooling medium | | Water of 25° C. | Hot water of 145° C. | Air of 30° C. |
| Flow rate of cooling medium | Upper Surface of the head of test piece | 11 l/minute.nozzle | 17 l/minute.nozzle | 19 $Nm^3$/minute.m |
| | Side surface of the head of test piece | 9 l/minute.nozzle | 15 l/minute.nozzle | 19 $Nm^3$/minute.m |

In Table 4, $L_1$ indicates the distance between the tip of the nozzle 12 and the upper surface of the head of the test piece 1; $L_2$, the distance between the tip of the nozzle 12 and the side surface of the head of the test piece 1; $L_3$, the distance between the tip of the nozzle 2 and the upper surface of the head of the test piece 1; $L_4$, the distance between the tip of the nozzle 2 and the side surface of the head of the test piece 1; $L_5$, the distance between the tip of the nozzle 9 and the upper surface of the head of the test piece 1; and $L_6$, the distance between the tip of the nozzle 9 and the side surface of the head of the test piece 1.

Figure 16:
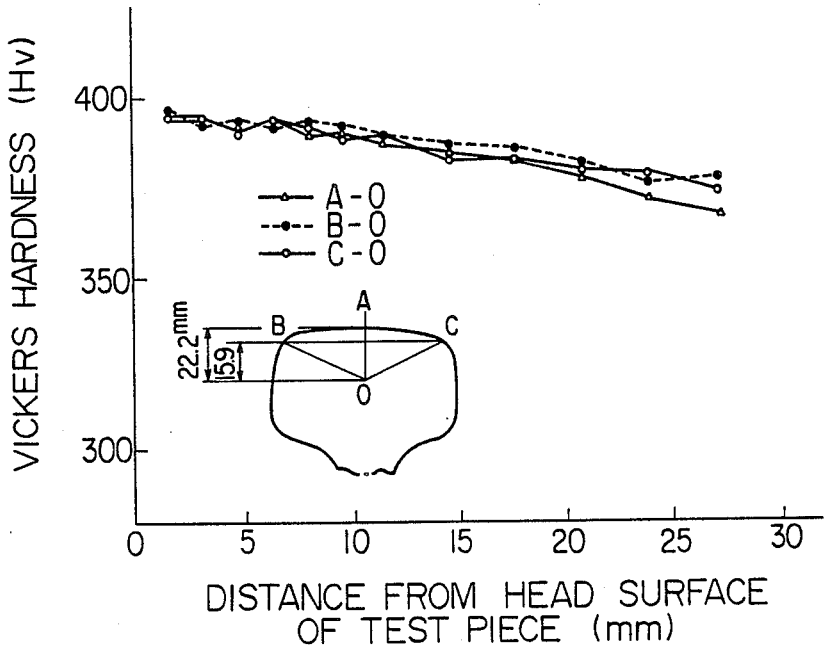
FIG. 16 is a graph illustrating the relationship between the distance from a head surface of a test piece of a rail and Vickers hardness.

The macrostructure and Vickers hardness of the head of the test piece were investigated. As a result, the macrostructure was transformed into a uniform and fine pearlite structure, and no abnormal structure was observed. The Vickers hardness distribution is shown in FIG. 16. As is clear from FIG. 16, Vickers hardness of the head of the test piece shows very small variations and has a value giving a sufficient wear resistance.

EXAMPLE 4

A 136 pound/yard rail, immediately after rolling, made of rail containing 0.78 wt. % C., 0.56 wt. % Si, 0.86 wt. % Mn, 0.002 wt. % P, 0.007 wt. % S, 0.447 wt. % Cr, and 0.054 wt. % V was caused to pass, at a speed of 7.2 m/minute, through a cooling zone by the water spray (length: 15 m, water temperature: 25° C.) provided with the conventional nozzles for the water spray, a cooling zone by the hot water jet (length: 6 m, hot water temperature: 145° C.) provided with the nozzles for the hot water jet as shown in FIG. 8, and a cooling zone by the air jet (length: 9 m, air temperature: 30° C.) provided with the nozzles for the air jet as shown in FIG. 9, to cool the rail head until the surface temperature of the rail head reached a temperature of 550° C. in the cooling zone by the water spray, then to cool same until the surface temperature of the rail head reached a temperature of 450° C. in the cooling zone by the hot water jet, and then to cool same until the surface temperature of the rail head reached a temperature of 300° C. in the cooling zone by the air jet. For comparison purposes, the head of the rail of the same kind was cooled only through a cooling zone by the water spray (length: 30 m, water temperature: 25° C.) provided with the conventional nozzles for the water spray, to investigate the Vickers hardness distribution in the longitudinal direction of the rail at a depth of 20 mm below the upper surface of the rail head.

Figure 17:
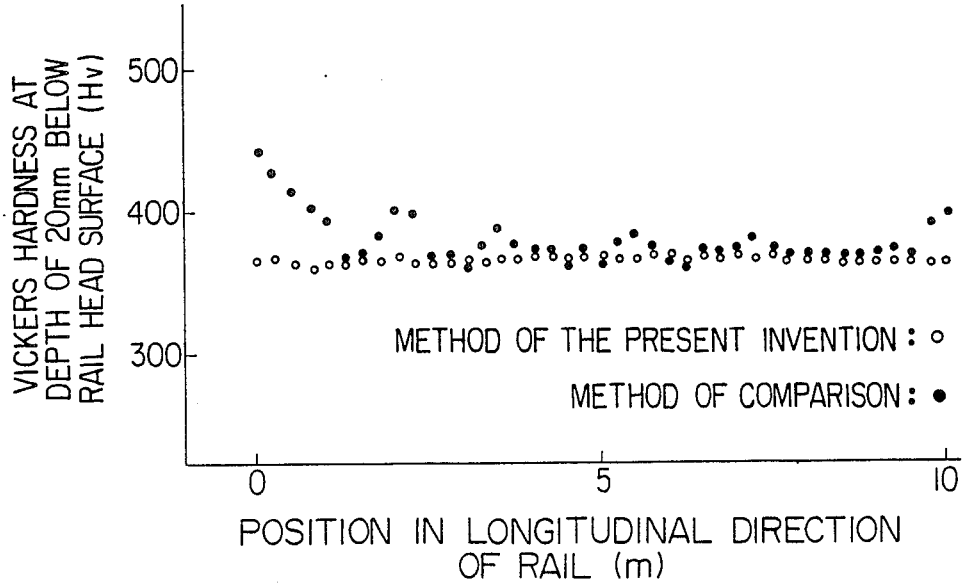
FIG. 17 is a graph illustrating the relationship between a position in the longitudinal direction of a rail and Vickers hardness at a depth of 20 mm below a rail head surface in the case where the rail head is heat-treated by another embodiment of the method of the present invention and the method of comparison.

The result is shown in FIG. 17. As is clear from FIG. 17, the method of the present invention gives a far smaller variation in the Vickers hardness distribution in the longitudinal direction of the rail than in the method of comparison. While the method of the present invention requires a water consumption of 19 $m^3$/hr. in the cooling zone by the water spray, the method of comparison requires a water consumption of 38 $m^3$/hr. In addition, the method of the present invention requires a hot water consumption of 5 $m^3$/hr. in the cooling zone by the hot water jet, which is considerably smaller than that in the above-mentioned EXAMPLE 2, thus permitting minimization of the scale of the heat treatment facilities to that extent. The method of the present invention requires an air consumption of 5,700 $Nm^3$/hr. in the cooling zone by the air jet, which is smaller by about 70% than that in the case of the cooling by the air jet alone, thus permitting minimization of the scale of the heat treatment facilities to that extent.

According to the present invention, as described above, it is possible to uniformly cool a rail head, and minimize the scale of the heat treatment facilities, thus providing industrially useful effects.

What is claimed is:

1. In a method for heat-treating a steel rail head, which comprises:

heating a steel rail head to the austenization temperature; and then, continuously cooling said rail head so that the structure of a surface portion thereof transforms into a uniform and fine pearlite structure;

the improvement characterized by:

carrying out said cooling of said rail head by means of a hot water jet until a surface temperature of said rail head decreases to a temperature not below 420° C.; and then cooling said rail head by means of an air jet to at least the pearlite transformation temperature.

2. The method as claimed in claim 1, wherein:

said rail head is previously cooled by means of a water spray until said surface temperature of said rail head decreases to a temperature not below 530° C. prior to said cooling of said rail head by means of said hot water jet.

* * * * *